US008952824B2

(12) United States Patent
Drimusz et al.

(10) Patent No.: US 8,952,824 B2
(45) Date of Patent: Feb. 10, 2015

(54) AUDIO SYSTEM SURROUND ACOUSTIC DRIVER POWERING

(75) Inventors: Laszlo Otto Drimusz, Framingham, MA (US); Eric D. Scheirer, West Newton, MA (US); Brendan M. Welch, Uxbridge, MA (US)

(73) Assignee: Bose Corporation, Framingham, MA (US)

( * ) Notice: Subject to any disclaimer, the term of this patent is extended or adjusted under 35 U.S.C. 154(b) by 100 days.

(21) Appl. No.: 13/554,005

(22) Filed: Jul. 20, 2012

(65) Prior Publication Data

US 2014/0022084 A1 Jan. 23, 2014

(51) Int. Cl.
*G08B 21/00* (2006.01)

(52) U.S. Cl.
USPC ..... 340/636.2; 320/107

(58) Field of Classification Search
USPC ..... 340/636.2; 381/77, 303; 320/107
See application file for complete search history.

(56) References Cited

U.S. PATENT DOCUMENTS

| | | | | |
|---|---|---|---|---|
| 4,899,388 | A * | 2/1990 | Mlodzikowski et al. | 381/77 |
| 5,889,383 | A * | 3/1999 | Teich | 320/107 |
| 6,731,761 | B1 | 5/2004 | Zablocki et al. | |
| 8,131,386 | B2 * | 3/2012 | Elberbaum | 700/58 |
| 2008/0137879 | A1 | 6/2008 | Schwartz et al. | |
| 2010/0188212 | A1 | 7/2010 | Jochelson | |

FOREIGN PATENT DOCUMENTS

| | | | |
|---|---|---|---|
| JP | 7312797 | A | 11/1995 |
| JP | 2000209687 | A | 7/2000 |
| JP | 2005236404 | A | 9/2005 |
| JP | 2007166584 | A | 6/2007 |
| WO | 2011/010968 | A1 | 1/2011 |

* cited by examiner

*Primary Examiner* — John A Tweel, Jr.
(74) *Attorney, Agent, or Firm* — Bose Corporation

(57) ABSTRACT

An audio system including wireless speakers. The wireless speakers include rechargeable batteries and are interchangeable so that two loudspeakers may be recharged while two loudspeakers are operating wirelessly.

23 Claims, 7 Drawing Sheets

AUDIO SYSTEM SURROUND ACOUSTIC DRIVER POWERING

BACKGROUND

This specification describes a method and apparatus for powering wireless satellite loudspeakers.

SUMMARY

In one aspect, an audio system includes a battery charger for charging rechargeable batteries and a loudspeaker assembly intended to be placed in back of a listening position. The loudspeaker assembly includes a rechargeable battery, a wireless audio signal receiver, an amplifier, and an acoustic driver. The rechargeable battery, the wireless audio signal receiver, the amplifier, and the acoustic driver may be packaged in a single module. The audio system may include four interchangeable modules, each comprising a loudspeaker assembly. The audio system may be decoupleable from an acoustic driver module including the amplifier and the acoustic driver. The battery charger may be a part of an audio system console. The battery charger may be part of a loudspeaker module. A wireless audio receiver module may include the wireless audio signal receiver and may be decoupleable from an acoustic driver module including the one rechargeable battery and the acoustic driver. The wireless audio receiver module may further include the amplifier. The wireless receiver module may be incorporated in a loudspeaker stand. The audio system may further include a second wireless receiver module, incorporated in a second loudspeaker stand and four interchangeable acoustic driver modules, each comprising another of the rechargeable batteries and another acoustic driver. The four interchangeable acoustic driver modules may each comprise another amplifier. The loudspeaker assembly may further include a photovoltaic cell for recharging the rechargeable battery. The battery charger may be an inductive charger. The battery charger may be housed in a system console. The battery charger may be housed in a speaker stand. The audio system may further include logic to estimate the energy remaining in the battery.

In another aspect, an audio system includes at least two battery chargers, coupled to an electrical power source and at least four loudspeaker assemblies. The four loudspeaker assemblies include two sets of two loudspeaker assemblies. Each loudspeaker assembly includes an acoustic driver and a rechargeable battery. The four loudspeaker assemblies are physically coupleable to at least one of the battery chargers. The four loudspeaker assemblies are configured so that the four loudspeaker assemblies are operable when physically separated from the battery chargers. The audio system further includes circuitry for determining the state of charge of the rechargeable batteries when the loudspeaker assemblies are being operated physically separated from the battery chargers, and circuitry, responsive to the circuitry for determining the state of charge of the rechargeable batteries, for informing a user that the state of charge of at least one of the rechargeable batteries is below a predetermined level. The two sets of two loudspeaker assemblies may be interchangeable so that the four loudspeakers are interchangeable with each other. The four loudspeaker assemblies may further include an amplifier and a wireless receiver. The loudspeaker assemblies may be coupleable to a device comprising a wireless receiver and an amplifier. The audio system may further include a third battery charger. The audio system may further include logic for determining the relative position of two of the loudspeaker assemblies that are physically separated from a system console.

In another aspect, a method for identifying the relative location of at least two loudspeakers includes positioning at least two acoustic drivers in a room; causing each of two drivers to radiate acoustic energy; detecting, by a first microphone, radiation from each of the two acoustic drivers; determining one of the distance or the relative distance of the first loudspeaker and of the second loudspeaker from the first microphone; detecting, by a second microphone, radiation from each of the two acoustic drivers; determining one of the distance or the relative distance of the first loudspeaker and of the second loudspeaker from the second microphone; based on the distances or the relative distances of the first loudspeaker and the second loudspeaker from the first microphone and the second microphone, determining that one of the first loudspeaker and the second loudspeaker may be a left surround loudspeaker and other of the first loudspeaker and the second loudspeaker may be a right surround.

Other features, objects, and advantages will become apparent from the following detailed description, when read in connection with the following drawing, in which:

DETAILED DESCRIPTION

Figure 1:
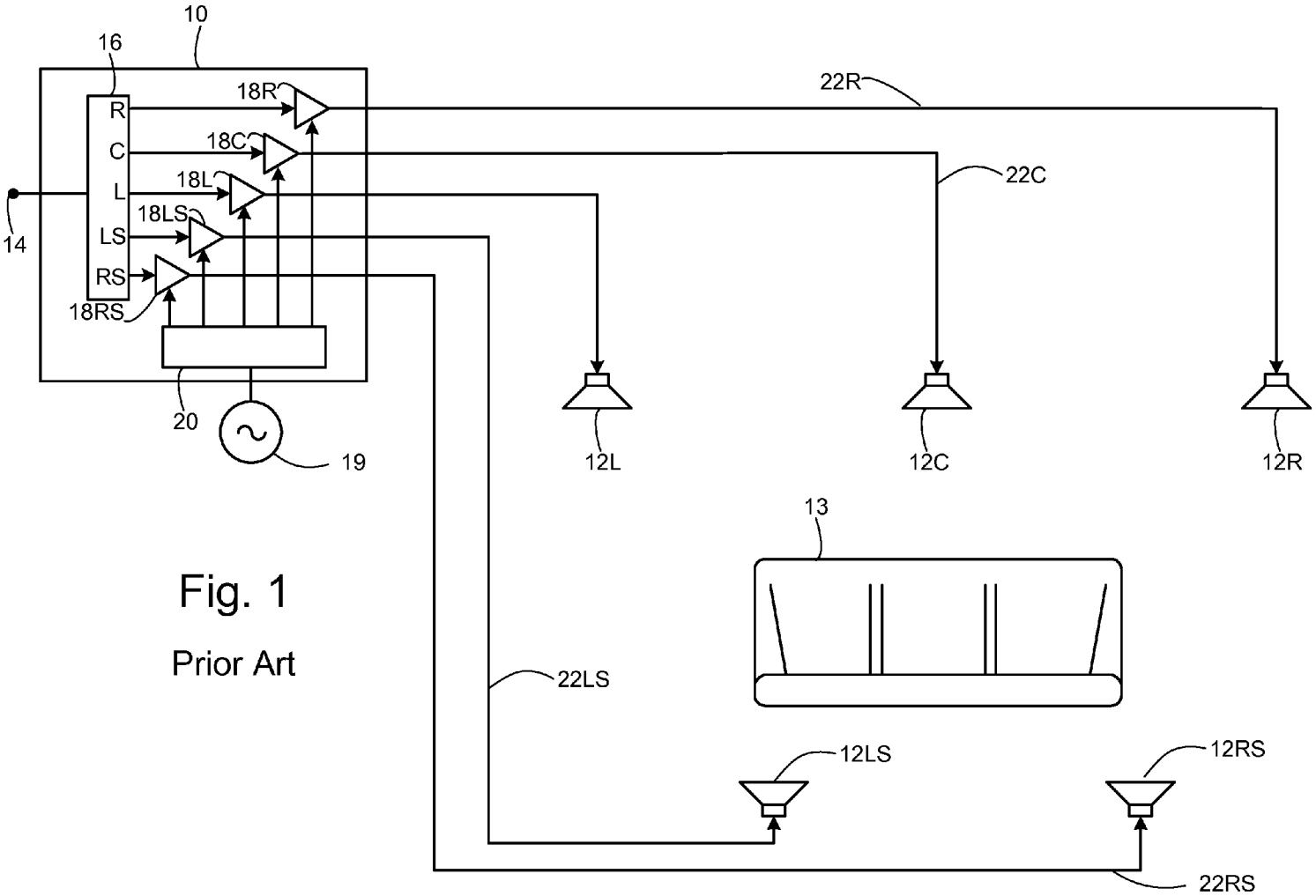
Fig. 1 Prior Art
FIG. 1 is a block diagram of a prior art audio system.

Though the elements of several views of the drawing may be shown and described as discrete elements in a block diagram and may be referred to as "circuitry", unless otherwise indicated, the elements may be implemented as one of, or a combination of, analog circuitry, digital circuitry, or one or more microprocessors executing software instructions. The software instructions may include digital signal processing (DSP) instructions. Operations may be performed by analog circuitry or by a microprocessor executing software that performs the mathematical or logical equivalent to the analog operation. Unless otherwise indicated, signal lines may be implemented as discrete analog or digital signal lines, as a single discrete digital signal line with appropriate signal processing to process separate streams of audio signals, or as elements of a wireless communication system. Some of the processes may be described in block diagrams. The activities that are performed in each block may be performed by one element or by a plurality of elements, and may be separated in time. The elements that perform the activities of a block may be physically separated. Unless otherwise indicated, audio signals or video signals or both may be encoded and transmitted in either digital or analog form; conventional digital-to-analog or analog-to-digital converters may not be shown in the figures.

A "module", as used herein, refers to a collection of interconnected devices that is packaged in a single physical unit and is designed to be detachably connected to other modules for example by a plug-in cable or by mating connectors built into the two modules.

FIG. 1 is a logical arrangement of a prior art multichannel (in this example a five channel) audio system. Multichannel audio systems, particularly systems using satellite speakers, often include subwoofers or low frequency devices. However, the systems disclosed in this specification are implementable with or without a subwoofer, so the subwoofer is not included in this or subsequent figures. The multichannel audio system includes an audio system console 10 coupled to five acoustic drivers including a left acoustic driver 12L, a right acoustic driver 12R, a center acoustic driver 12C, a left surround acoustic driver 12LS, and a right surround acoustic driver 12RS. The left acoustic driver 12L, the center acoustic driver 12C, and the right acoustic driver 12R are positioned in front of a listening area, represented here by a sofa 13. The center channel acoustic driver 12C is typically positioned in the vicinity of a monitor or television (not shown in this view) so sound coming from the center channel acoustic driver 12C is localized at or near the television screen. The left surround acoustic driver 12LS and the right surround acoustic driver 12RS are typically positioned behind the listening area. Other multichannel audio systems may have only a single surround acoustic driver or may have additional surround acoustic drivers; for example a six channel system may also have a center surround acoustic driver.

The audio system console 10 includes an input terminal for audio signals. For simplicity, the system of FIG. 1 is shown with a single input terminal 14. In an actual implementation, the audio system console may include an internal audio signal source, for example, a radio tuner and may further include input terminals for audio signals from multiple sources, for example a cable television receiver, a satellite receiver, a digital video recorder (DVR), a personal video recorder (PVR), a personal media storage device, a wireless transmission receiver, or a computer network. If the audio system console 10 includes an internal audio signal source, or multiple input terminals, or both, the audio system console may further include circuitry for selecting the audio signal source.

The audio system console 10 may further include a decoder 16 for decoding the audio signals from the input terminal in to multiple audio channels. The individual channels are provided to amplifiers 18L, 18R, 18C, 18LS, and 18RS, which amplify the audio signals that are transmitted to the acoustic drivers. Power for the amplifiers is typically provided by a power source 19, for example a standard household alternating current (AC) wall plug. The power from the wall plug may be processed by power processing circuitry 20 (for example the alternating current may be converted to direct current (DC), and adjusted to a different voltage) so that the electrical power is suitable for the amplifiers.

In the audio system of FIG. 1, the amplified audio signals are transmitted to the acoustic drivers 12L, 12R, 12C, 12LS, 12RS through physical audio cables 22L, 22R, 22C, 22LS, 22RS, respectively. Front physical audio cables 22L, 22R, and 22C, are typically relatively unobtrusive and simple to place. However rear physical audio cables 22LS and 22RS may be bothersome to put in position. The cable may cause hazards (for example, tripping hazards or electrical hazards), may be subject to damage, for example by children or pets, may be cosmetically undesirable, or may be inconvenient to install (for example requiring drilling holes in the ceiling or floor, feeding the cable though the hole and laying the cable across an attic or basement, drilling another hole, and feeding the audio cable through the hole).

Figure 2:
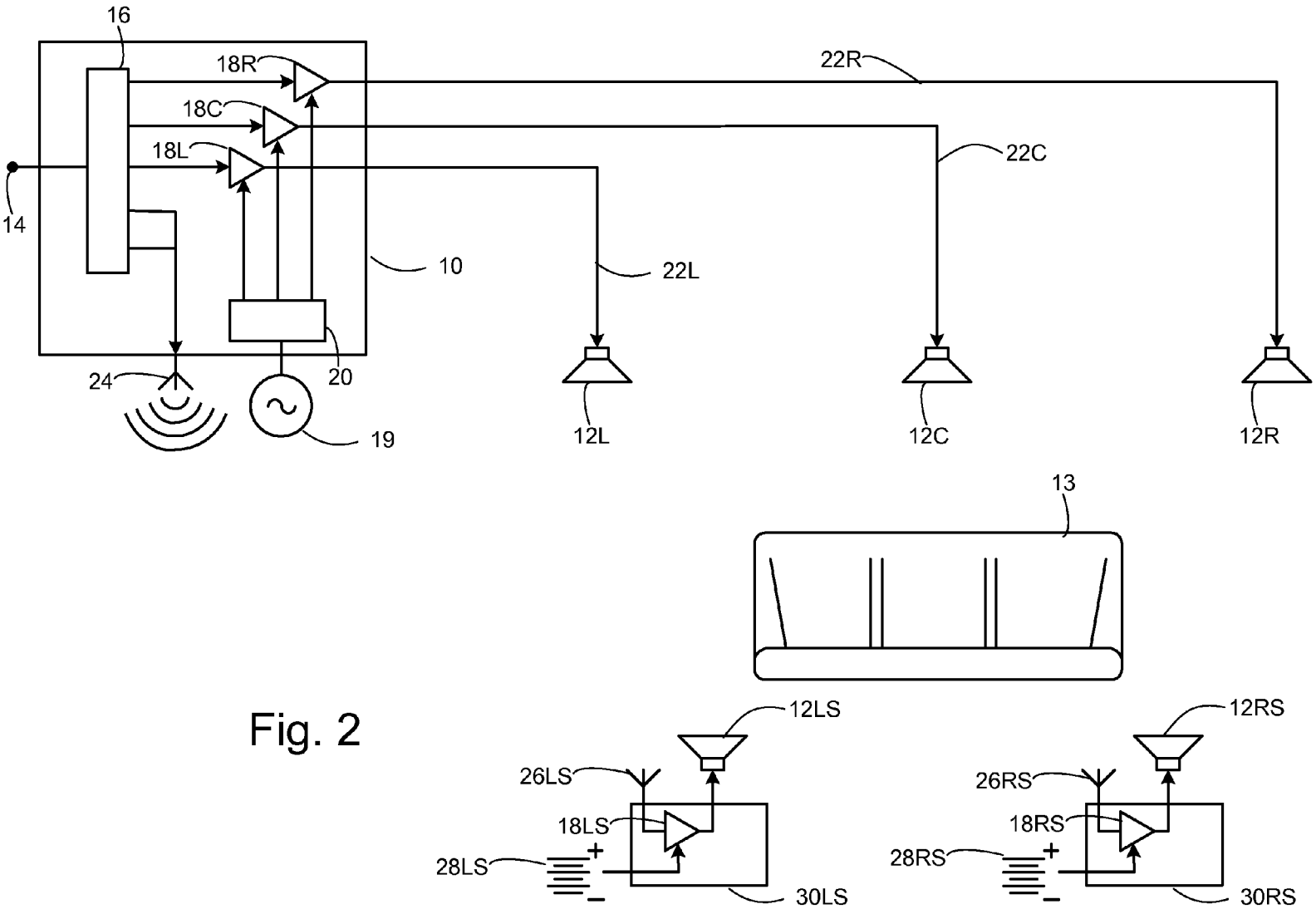
FIGS. 2-4 are block diagrams of audio systems.

FIG. 2 is a logical arrangement of a multichannel audio system which does not require physical cable to transmit audio signals to the surround acoustic drivers. In the system of FIG. 2, left surround physical audio cable 22LS of FIG. 1 is replaced by a wireless audio signal transmitter 24 and wireless audio signal receiver 26LS. A left surround acoustic driver signal processor module 30LS includes wireless audio signal receiver 26LS and an amplifier positioned logically between the wireless audio signal receiver 26LS and acoustic driver 12LS. Similarly, right surround physical audio cable 22RS of FIG. 1 is replaced by the wireless audio signal transmitter 24 and wireless audio signal receiver 26RS. A right surround acoustic driver signal processor module 30RS includes wireless audio signal receiver 26RS, an amplifier positioned logically between the wireless audio signal receiver 26RS and acoustic driver 12RS. The physical positioning and packaging of the signal processor modules 30LS and 30RS, wireless audio signal receivers 26LS and 26RS, the amplifiers 18LS and 18RS, and the acoustic drivers 12LS and 12RS will be discussed below.

Power to amplifiers 18LS and 18RS may be provided in the same manner as in the system of FIG. 1, by using AC power from wall plugs and processing the electrical power by power processing circuitry; however it is frequently desirable to eliminate all cables including both audio signal cables and electrical power cables to the surround acoustic drivers, so amplifiers 18LS and 18RS may be powered by batteries 28LS and 28RS, respectively. In some implementations, batteries 28LS and 28RS may be rechargeable batteries. The configuration of FIG. 2 eliminates the undesirable cables to the surround acoustic drivers 12LS and 12RS.

In operation, the decoder 16 decodes the audio signal from terminal 14 into a plurality of channels, in this example, a left channel L, a right channel R, a center channel C, a left surround channel LS, and a right surround channel RS. The left channel signal is amplified by amplifier 18L and transmitted over physical cable 22L to the left acoustic driver 12L, which transduces the amplified left channel audio signal to acoustic energy. Similarly, the right channel signal and the center channel signal are amplified, transmitted, and transduced. The left surround channel audio signal is transmitted by the wireless audio signal transmitter 24 to the left surround wireless audio signal receiver 26LS, amplified, and transduced. Similarly, the right surround channel audio signal is transmitted by the wireless audio signal transmitter 24 to the right surround wireless audio signal receiver 26RS, amplified, and transduced.

Figure 3:
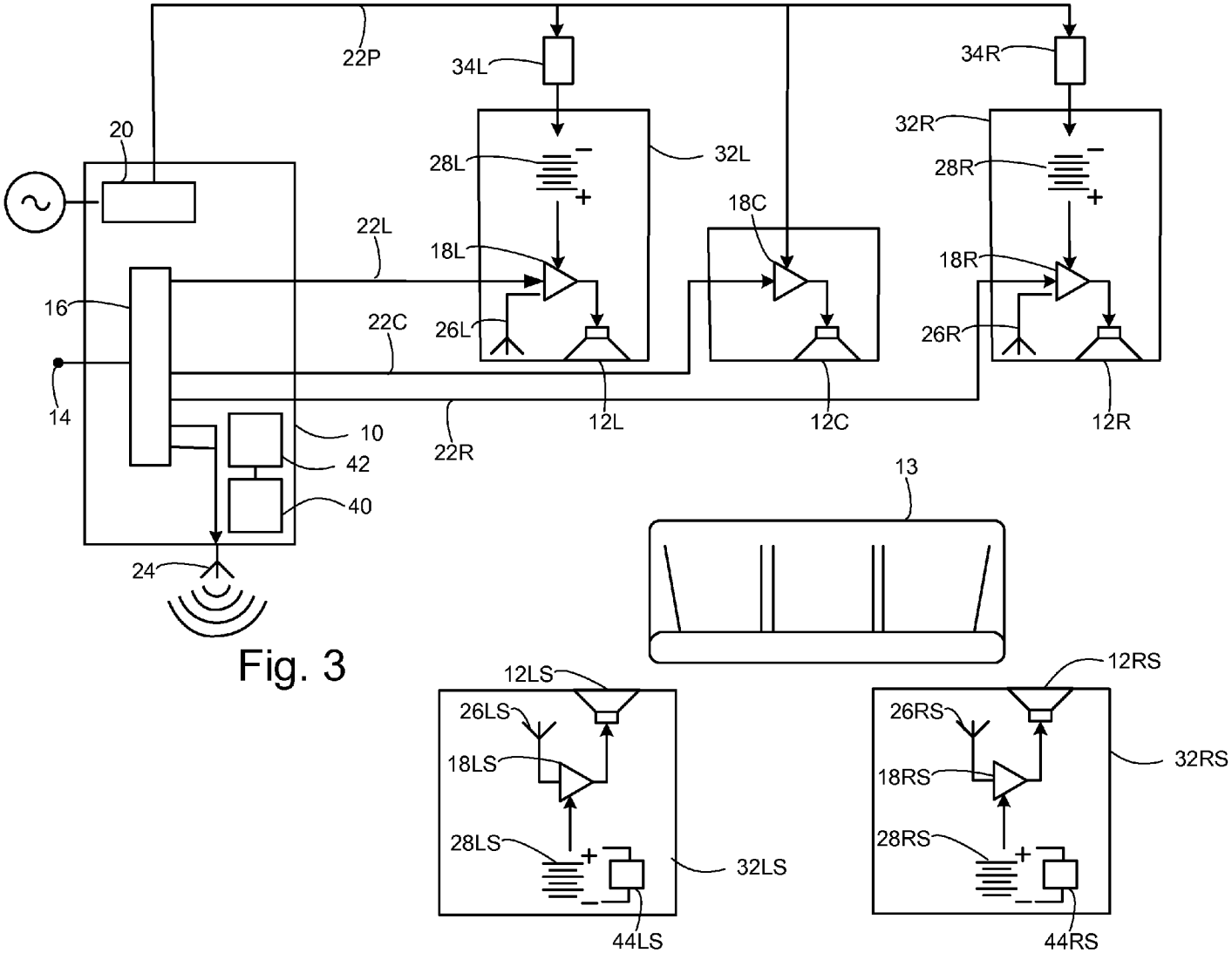

FIG. 3 is a logical arrangement of another multichannel audio system. The multichannel audio system of FIG. 3 includes the elements of the multichannel audio system of FIG. 2, and includes some additional elements that will be described below. In the system of FIG. 3, a left surround loudspeaker module 32LS includes left surround battery 28LS, left surround wireless audio signal receiver 26LS, left surround amplifier 18LS and left surround acoustic driver 12LS. Similarly, right surround loudspeaker module 32RS includes right surround battery 28RS, right surround wireless audio signal receiver 26RS, right surround amplifier 18RS and right surround acoustic driver 12RS.

Also, in the system of FIG. 3, a left loudspeaker module 32L includes left battery 28L, left wireless audio signal receiver 26L, left amplifier 18L and left acoustic driver 12L. Similarly, right loudspeaker module 32R includes right battery 28R, right wireless audio signal receiver 26R, right amplifier 18R and right acoustic driver 12R, so that left loudspeaker module 32L and right loudspeaker module 32R have the same elements as left surround loudspeaker module 32LS and right surround loudspeaker module 32RS. Electrically coupled to power processing circuitry 20 by power cable 22P are battery chargers 34L and 34R. Left loudspeaker module 32L may be packaged so that the left battery 28L may be removably coupled to the left battery charger 34L but is not mechanically coupleable to right battery charger 34R. Right loudspeaker module 32R may be packaged so that the right battery 28R may be removably coupled to the right battery charger 34R but is not mechanically coupleable to left battery charger 34R. In this configuration, left battery charger 34L should be mechanically and electrically compatible with left loudspeaker module 32L and left surround loudspeaker module 32LS and right battery charger 34R should be mechanically and electrically compatible with right loudspeaker module 32R and right surround loudspeaker module 32RS. This configuration ensures that left loudspeaker module 32L and left surround loudspeaker module 32LS always are on the left side and that right loudspeaker module 32R and right surround loudspeaker module 32R are always on the right side, eliminating the need for the identification procedure described below in the discussion of FIG. 6.

Optionally, the left loudspeaker module 32L may be packaged so that the left acoustic driver 12L may be removably coupled to the right battery charger 34R, and the right loudspeaker module 32R may be packaged so that the right acoustic driver 12R may also be removably coupled to the left battery charger 34L. The battery chargers 34L and 34R may be incorporated in a loudspeaker stand. In this configuration, left battery charger 34L should be mechanically and electrically compatible with left loudspeaker module 32L, left surround loudspeaker module 32L, right loudspeaker module 32R and right surround loudspeaker module 32RS. Similarly, right battery charger 34R should be mechanically and electrically compatible with left loudspeaker module 32L, left surround loudspeaker module 32L, right loudspeaker module 32R and right surround loudspeaker module 32RS. This configuration provides more flexibility to the user, but may require the identification procedure described below in the discussion of FIG. 6.

Similarly, a right loudspeaker module 32R includes the right acoustic driver 12R and also includes a right wireless audio signal receiver 26R, a right amplifier 18R and a right battery 28R, so that right loudspeaker module 32R has the same elements as right surround loudspeaker module 32RS and left surround loudspeaker module 32LS. Right loudspeaker module 32R may be packaged so that the right battery 28R may be removably coupled to right battery charger 34R, but is not mechanically coupleable to left battery charger 34L. Optionally, the right loudspeaker module 32R may be packaged so that the right acoustic driver 12R may be removably coupled to the left amplifier 18L and so that right battery 28R may be removably coupled to left battery charger 34L. The advantages of these two configurations are discussed above.

For the purpose of illustration, a power cable 22P is shown as separate from physical cables 22L, 22C, and 22R. In an actual implementation, the power may be transmitted to battery chargers 34L and 34R and to center amplifier 18C over physical cables 22L, 22R, and 22C, respectively.

Additionally, left surround loudspeaker module 32LS may be packaged so that the left surround battery 28LS may be removably coupled to battery charger 34L. Optionally, the left surround loudspeaker module 32LS may be packaged so that the left surround battery 28LS may be removably coupled to right surround battery charger 34R. Similarly, right surround loudspeaker module 32RS may be packaged so that the right surround battery 28RS may be removably coupled to the right battery charger 34R. Optionally, the right loudspeaker module 32RS may be packaged so that the right battery 28R may be removably coupled to left battery charger 34L.

The audio system of FIG. 3 shows the center loudspeaker module 32C as including an amplifier 18C and an acoustic driver 12C, but not a battery. Instead, the amplifier 18C is powered by electric power transmitted over physical cable 22P. This permits the center channel acoustic driver module to have different characteristics (for example, a different equalization pattern, a different acoustic driver, a different amplifier) than loudspeaker modules 32L, 32R, 32LS, and 32RS, and does not require that the center loudspeaker module 32C have a battery, and does not require a battery charger for the center loudspeaker module. In an alternative configuration, the loudspeaker module 32C has the same elements as loudspeaker modules 32L, 32R, 32LS, and 32RS and therefore could be interchanged, as will be described below. There may be a center channel battery charger (instead of or in addition to the left battery charger 34L and right battery charger 34R) packaged so that a battery of a center channel module could be removably coupled to the center channel battery charger.

In operation, the decoder 16 decodes the audio signal from terminal 14 into a plurality of channels, in this example, a left channel L, a right channel R, a center channel C, a left surround channel LS, and a right surround channel RS, as in the audio systems of FIGS. 1 and 2. In the audio system of FIG. 3, the left channel signal may be transmitted to left loudspeaker module 32L via a physical cable 22L, amplified by left amplifier 18L, and transduced to acoustic energy by acoustic driver 12L. Similarly, the right channel audio signal and the center channel audio signal may be transmitted by a physical cable 22R, then amplified, and transduced by the appropriate amplifier and acoustic driver.

While the left battery 28L is electrically coupled to the left battery charger 34L, the left battery charger 34L charges the battery 28L if necessary. Similarly, while the right battery 28R is electrically coupled to the right battery charger 34R, the right battery charger 34R charges the battery 28R if necessary.

The left surround channel signal is transmitted wirelessly by the wireless audio signal transmitter 24 to the left surround wireless audio signal receiver 26LS. The audio signal is then amplified by left surround amplifier 18LS (which is powered by left surround battery 28LS) and transduced by left surround acoustic driver 12 LS. Similarly, the right surround channel signal is transmitted wirelessly by the wireless audio signal transmitter 24 to the right surround wireless audio signal receiver 26RS. The audio signal is then amplified by right surround amplifier 18RS (which is powered by right surround battery 28RS) and transduced by right surround acoustic driver 12 RS.

When the left surround battery 28LS is discharged beyond a predetermined point (for example, as indicated by the voltage dropping below a predetermined voltage) the audio system alerts the user by, for example, audibly broadcasting a message or a warning signal or tone, or by visually displaying a message or illuminating a warning light.

The circuitry for determining when the left surround battery 28LS is discharged beyond a predetermined point can include logic in the audio system console 10 which monitors the audio signals transmitted to the left surround wireless audio signal receiver 26LS and estimates the energy remaining in the battery 28LS. The estimating can be done by a microprocessor 40 in the audio system console 10 that records the amount of energy stored in the battery when the battery is removed from the battery charger 34L and simulates the energy requirement of the amplifier 18LS. One method for simulating the energy requirement of the amplifier 18LS is to integrate the left surround audio signal amplitude by time and the efficiency of the amplifier circuit, which may, in some cases be dependent on the amplitude of the audio signal; the relationship between the amplifier circuit efficiency and the audio signal amplitude may be calculated by the microprocessor 40 or may be retrieved by the microprocessor from a lookup table 42.

The accuracy of the simulation can be improved by including more parameters in the calculation or adding addition lookup tables for the added parameters. Added parameters could include temperature, battery self discharge over time when idle, and battery life, that is, the number of times the battery has been discharged.

Alternatively, the circuitry for determining when the left surround battery 28LS is discharged beyond a predetermined point can be a simple voltage measuring device 44LS in the left surround loudspeaker module 32LS. In one implementation, the low battery condition could be communicated to the audio system console 10 if the wireless audio signal transmitter 24 is also a wireless receiver and the left surround wireless audio signal receiver 26LS is also a transmitter or if the left surround loudspeaker includes a wireless transmitter.

The alerting the user could include one of or a combination of transmitting an audio signal from the console 10 to the loudspeaker module 32LS and transducing the audio signal by acoustic driver 32LS; transducing an audio signal stored in left surround loudspeaker module 32LS; or illuminating a warning light such as an LED on loudspeaker module 32LS. In some configurations, the audio system may provide the user with the ability to select the method by which the system alerts the user to a discharged battery condition.

The user can then exchange the left loudspeaker module 32L (which includes charged battery 28L) and the left surround loudspeaker module 32LS (which includes discharged battery 28LS). The left surround loudspeaker module 32LS is then positioned where the left loudspeaker module 32L was formerly positioned and the left surround battery 28LS is electrically coupled to the left battery charger 34L. The left surround loudspeaker module 32LS (in its exchanged position) is then used to amplify and transduce the left channel audio signal L and the left surround battery 28 LS is charged by the left battery charger 34L. The left loudspeaker module 32L (in its exchanged position and now powered by left battery 28L, which is now charged) is used to amplify and transduce the left surround audio channel.

Similarly, when the right surround battery 28Rs is discharged beyond a predetermined point (for example, as indicated by the voltage dropping below a predetermined voltage) the audio system alerts the user by, for example, audibly broadcasting a message or a warning signal or tone, or by visually displaying a message or illuminating a warning light. The user can then exchange the right loudspeaker module 32R (with charged battery 28R) and the right surround loudspeaker module 32RS (with discharged battery 28RS). The right surround loudspeaker module 32RS is then positioned where the right loudspeaker module 32R was formerly positioned and the right surround battery 28RS is electrically coupled to the right battery charger 34R. The right surround loudspeaker module 32RS (in its exchanged position) is then used to amplify and transduce the right channel audio signal and the right surround battery 28 RS is charged by the right battery charger 34R. The right loudspeaker module 32R (in its exchanged position and now powered by right battery 28R, which is now charged) is used to amplify and transduce the right surround channel signal.

The circuitry for determining when the right surround battery 28RS is discharged beyond a predetermined point can include logic in the audio system console 10 which monitors the audio signals transmitted to the right surround wireless audio signal receiver 26RS to and estimates the energy remaining in the battery 28RS, as described above in the discussion of the left surround loudspeaker module 32LS.

Alternatively, the circuitry for determining when the right surround battery 28RS is discharged beyond a predetermined point can be a simple voltage measuring device in the right surround loudspeaker module 32RS, as described in the discussion of the left surround audio module 32LS.

The alerting the user could include one of or a combination of transmitting an audio signal from the console 10 to the loudspeaker 32LS and transducing the audio signal by acoustic driver 12RS; transducing an audio signal stored in left surround loudspeaker module 32LS; or illuminating a warning light such as an LED on loudspeaker module 32LS. In some configurations, the audio system may provide the user with the ability to select the method by which the system alerts the user to a discharged battery condition.

In the audio system of FIG. 3, the left wireless audio signal receiver 26L and the right wireless audio signal receiver 26R are not required since the audio signal may be transmitted by physical cables 22L and 22R. In a variation of the audio system of FIG. 3, the left channel audio signal is transmitted to the left wireless audio signal receiver 26L and the right channel audio signal is transmitted to the right wireless audio signal receiver 26R. In this variation, the physical cables 22L and 22R are used to transmit only the electrical power but are not required to transmit audio signals to left loudspeaker module 32L and right loudspeaker module 32R.

If loudspeaker modules 32L, 32R, 32LS, and 32RS are all configured so that they can be charged by either of battery chargers 34L or 34R, it may be necessary to provide some way of identifying the loudspeaker modules, so that, for example, if loudspeaker module 32L were exchanged with loudspeaker module 32RS and loudspeaker module 32R were exchanged with loudspeaker module 32LS, the correct signals could be transmitted wirelessly to the proper loudspeaker modules. A method of identifying the loudspeaker modules will be discussed below.

Battery chargers 34L and 34R may be conventional conductive battery chargers or could be inductive battery chargers. In the case of inductive chargers, "removably coupled" as used herein means that the rechargeable battery is positioned close enough to the inductive charger to permit charging even if there is no physical coupling. Inductive chargers could, for example, be built into a stand on which the loudspeaker is placed.

To provide for a longer interval during which batteries remain charged, the loudspeaker modules 32L, 32R, 32LS, and 32RS could include photovoltaic cells to charge the loudspeaker module batteries 28L, 28R, 28LS, and 28RS from ambient light.

Figure 4:
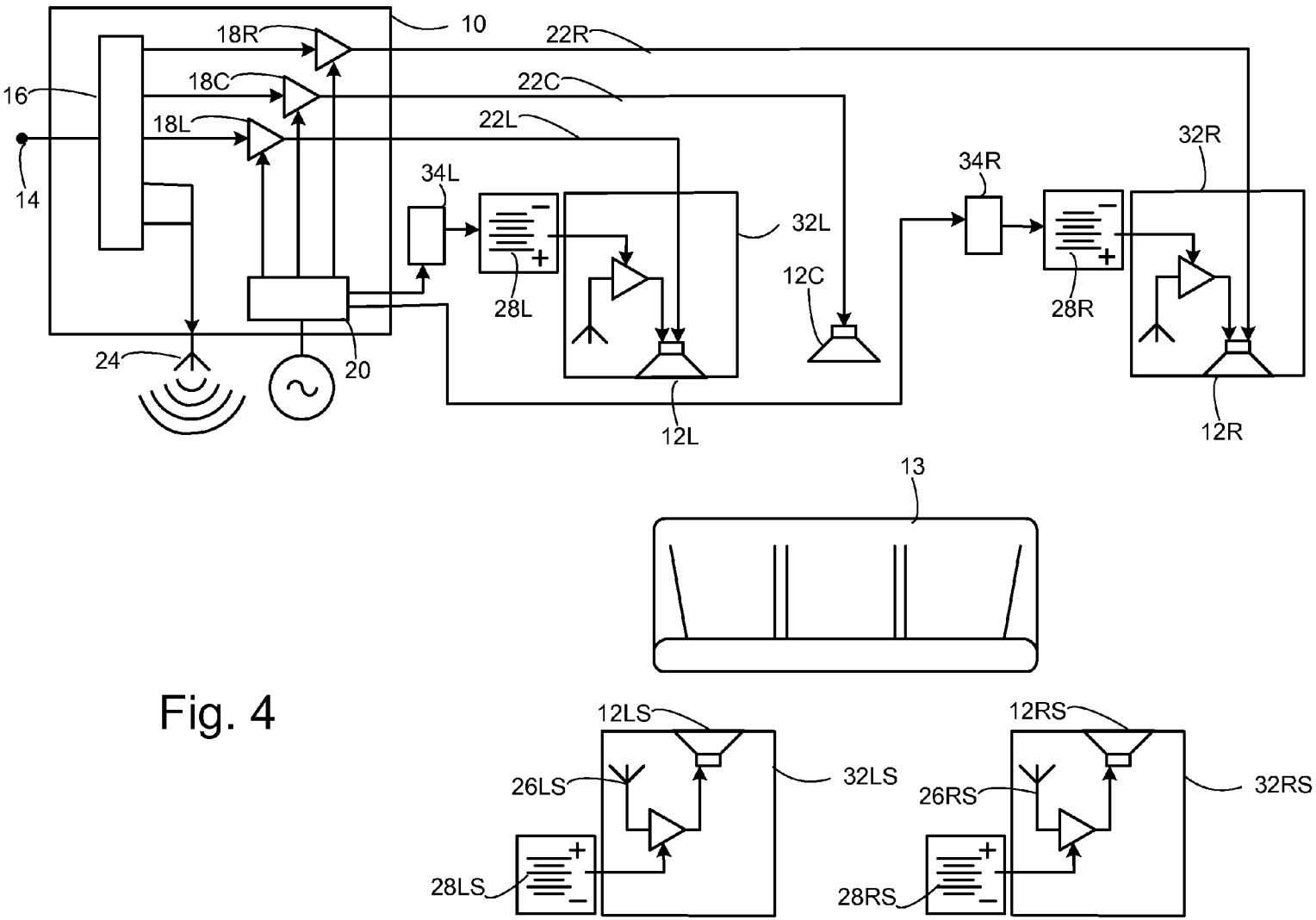

FIG. 4 is a logical arrangement of another audio system. In the audio system of FIG. 4, left loudspeaker module 32L and right loudspeaker module 32R do not have a wireless audio signal receiver, and may be configured to be powered by the power processing circuitry 20 and not by a battery. Batteries 28L, 28R, 28LS, and 28RS are packaged so that they can be detachably coupled to loudspeaker modules 32L, 32R, 32LS, and 32RS and detachably coupled to battery chargers 34L and 34R.

In operation, the decoder 16 decodes the audio signal from terminal 14 into a plurality of channels, in this example, a left channel L, a right channel R, a center channel C, a left surround channel LS, and a right surround channel RS, as in the audio systems of FIGS. 1 and 2. The left channel signal may be transmitted to left module 32L via a physical cable 22L, amplified by left amplifier 18L, and transduced to acoustic energy by acoustic driver 12L. Similarly, the right channel audio signal and the center channel audio signal may be transmitted by physical cable 22R, then amplified and transduced by amplifier 18R, and acoustic driver 12R. Left amplifier 18L and acoustic driver 12L may be powered by electrical power transmitted over physical cable 22L or by battery 28L, and right amplifier 18R and acoustic driver 12R may be powered by electrical power transmitted over physical cable 22R or by battery 28R.

While the left battery 28L is electrically coupled to the left battery charger 34L, the left battery charger 34L charges the battery 28L if necessary. Similarly, while the right battery 28R is electrically coupled to the right battery charger 34R, the right battery charger 34R charges the battery 28R if necessary.

The left surround channel signal is transmitted wirelessly by the wireless audio signal transmitter 24 to the left surround wireless audio signal receiver 26LS. The audio signal is then amplified by left surround amplifier 18LS (which is powered by left surround battery 28LS) and transduced by left surround acoustic driver 12 LS. Similarly, the right surround channel signal is transmitted wirelessly by the wireless audio signal transmitter 24 to the right surround wireless audio signal receiver 26RS. The audio signal is then amplified by right surround amplifier 18RS (which is powered by right surround battery 28RS) and transduced by right surround acoustic driver 12 RS.

When the left surround battery 28LS or the right surround battery 28RS is discharged beyond a predetermined point (for example, as indicated by the voltage dropping below a predetermined voltage) the audio system alerts the user by, for example, audibly broadcasting a message or a warning signal or tone, or by visually displaying a message or illuminating a warning light. The user can then exchange charged battery 28L with one of discharged batteries 28LS or 28RS, and exchange charged battery 28R with the other of the discharged batteries 28LS or 28RS.

In the operation of the audio system of FIG. 4, the loudspeaker modules 32L, 32R, 32LS, and 32RS are not moved or exchanged, so that no identification system is required. Additionally, if the left and right amplifier 18L and 18R, respectively, and the acoustic drivers 12L and 12R, respectively, are powered by power conducted over physical cable 22L and 22R, battery chargers 34L and 34R can be positioned near loudspeaker modules 32L or 32R, for example in a loudspeaker stand, but could also be positioned wherever is convenient; for example, the battery chargers 34L and 34R can be positioned in an audio system console 10, a bass module, or could even be standalone devices.

Figure 5A:
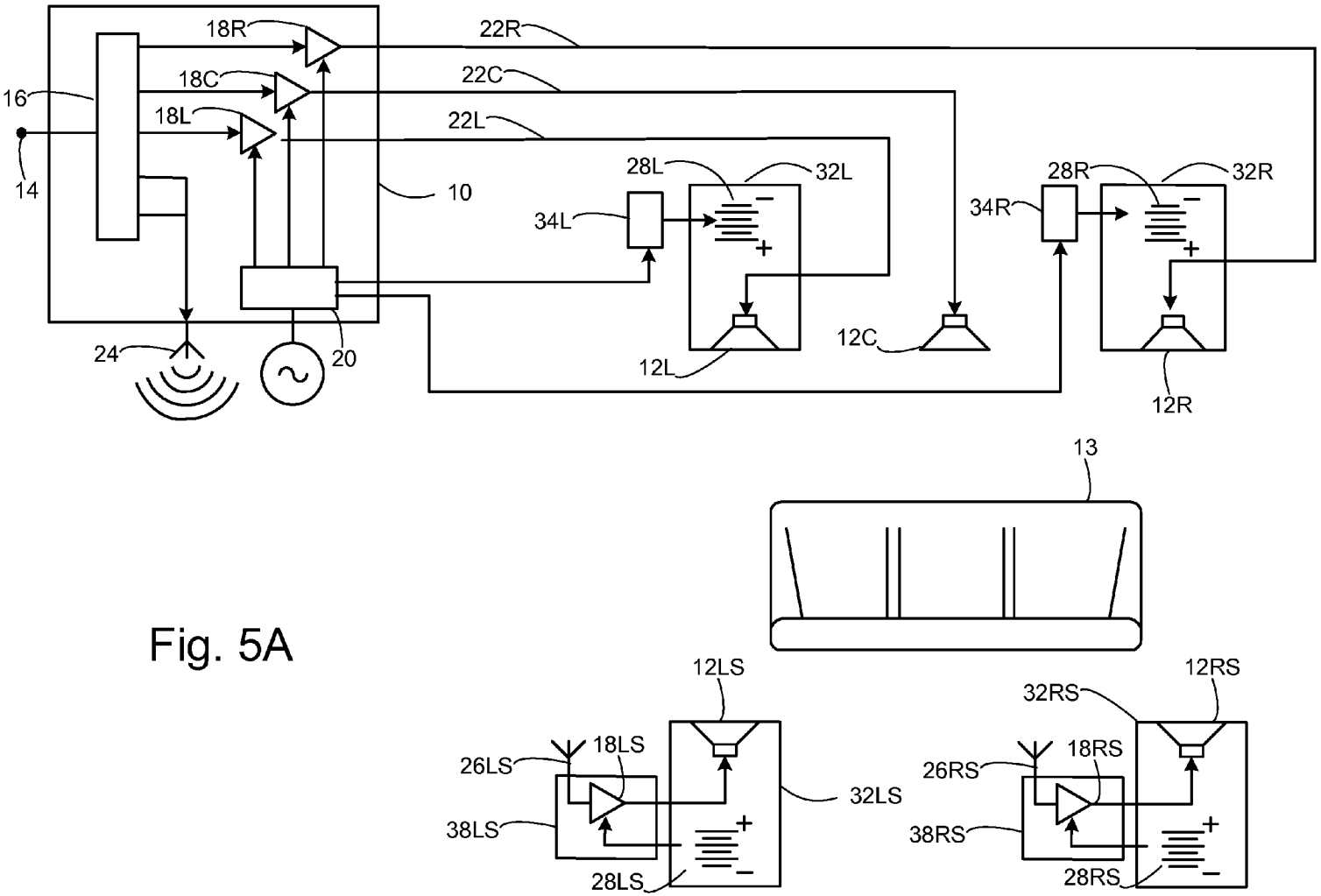
FIGS. 5A and 5B are block diagrams of audio systems.

FIG. 5A shows another audio system. Reference numbers correspond to similarly numbered elements in the previous drawings. The audio system of FIG. 5A includes two surround stands or bases 38LS and 38RS. Left surround stand 38LS includes left surround wireless audio signal receiver 26LS and may include left surround amplifier 18 LS. The left surround loudspeaker module 32LS includes left surround acoustic driver 12LS and left surround battery 28LS. The left surround loudspeaker module 32LS and the right surround loudspeaker module 32RS are detachably coupled to both stands 38LS and 38RS. The stands 38LS and 38RS are positioned at appropriate places in the room.

In operation, the decoder 16 decodes the audio signal from terminal 14 into a plurality of channels, in this example, a left channel L, a right channel R, a center channel C, a left surround channel LS, and a right surround channel RS, as in the audio systems of previous figures. In the audio system of FIG. 5A, the left channel signal may be transmitted to left module 32L via a physical cable 22L, amplified by left amplifier 18L, and transduced to acoustic energy by acoustic driver 12L. Similarly, the right channel audio signal and the center channel audio signal may be transmitted by a physical cable 22R, then amplified, and transduced by the appropriate amplifier and acoustic driver.

While the left battery 28L is electrically coupled to the left battery charger 34L, the left battery charger 34L charges the battery 28L if necessary. Similarly, while the right battery 28R is electrically coupled to the right battery charger 34R, the right battery charger 34R charges the battery 28R if necessary.

The left surround channel signal is transmitted wirelessly by the wireless audio signal transmitter 24 to the left surround wireless audio signal receiver 26LS. The audio signal is then amplified by left surround amplifier 18LS (which is powered by left surround battery 28LS) and transduced by left surround acoustic driver 12 LS. Similarly, the right surround channel signal is transmitted wirelessly by the wireless audio signal transmitter 24 to the right surround wireless audio signal receiver 26RS. The audio signal is then amplified by right surround amplifier 18RS (which is powered by right surround battery 28RS) and transduced by right surround acoustic driver 12 RS.

When the left surround battery 28LS is discharged beyond a predetermined point (for example, as indicated by the voltage dropping below a predetermined voltage) the audio system alerts the user by, for example, audibly broadcasting a message or a warning signal or tone, or by visually displaying a message or illuminating a warning light. The user can then exchange the left loudspeaker module 32L (which includes charged battery 28L) and the left surround loudspeaker module 32LS (which includes discharged battery 28R). The left surround loudspeaker module 32LS is then positioned where the left loudspeaker module 32L was formerly positioned and the left surround battery 28LS is electrically coupled to the left battery charger 34L. The left surround loudspeaker module 32LS (in its exchanged position) is then used to transduce the left channel audio signal and the left surround battery 28 LS is charged by the left battery charger 34L. The left loudspeaker module 32L (in its exchanged position) is used to transduce the left surround audio channel.

Similarly, when the right surround battery 28RS is discharged beyond a predetermined point (for example, as indicated by the voltage dropping below a predetermined voltage) the audio system alerts the user by, for example, audibly broadcasting a message or a warning signal or tone, or by visually displaying a message or illuminating a warning light. The user can then exchange the right loudspeaker module 32R (which includes charged battery 28R) and the right surround loudspeaker module 32RS (which includes discharged battery 28LS). The right surround loudspeaker module 32RS is then positioned where the right loudspeaker module 32R was formerly positioned and the right surround battery 28RS is electrically coupled to the right battery charger 34R. The right surround loudspeaker module 32RS (in its exchanged position) is then used to amplify and transduce the right channel audio signal and the right surround battery 28 RS is charged by the right battery charger 34R. The right loudspeaker module 32R (in its exchanged position) is used to amplify and transduce the right surround channel signal.

Figure 5B:
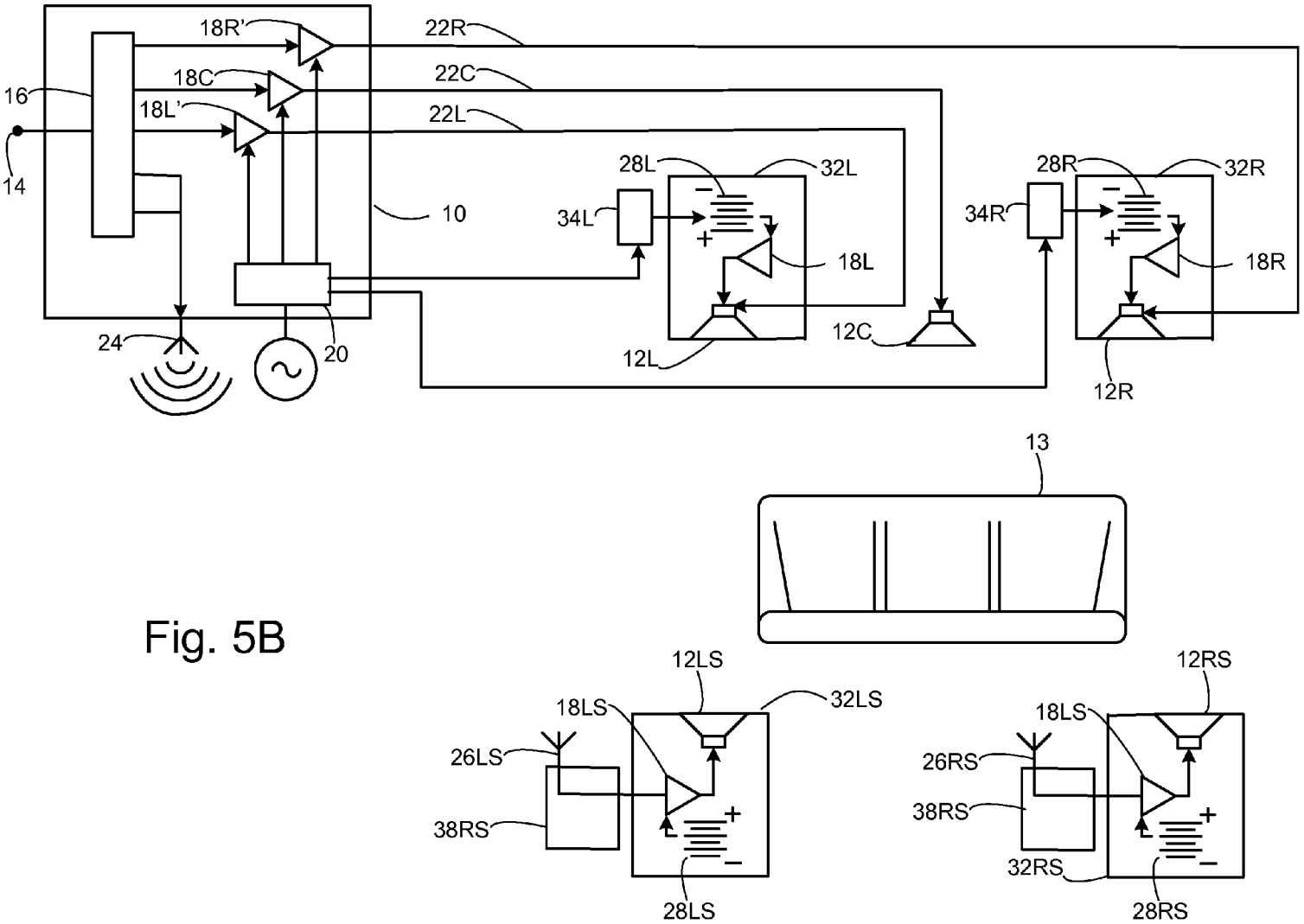

In the implementation of FIG. 5B, the loudspeaker modules 32LS and 32RS include amplifiers 18LS and 18RS, respectively, and left surround stand 38LS and 38RS include the wireless audio signal receivers 26LS and 26RS, respectively. In the implementation of FIG. 5B, the L channel audio signal could be amplified by amplifier 18L' in the head unit, and transmitted through physical cable 22L to acoustic driver 12L directly; in this implementation, amplifier 18L is not used, as indicated by the dashed lines. Alternatively, the unamplified L channel audio signal could be transmitted to amplifier 18L through physical cable 22L and amplified by amplifier 18L; in this alternative, amplifier 18L' is not necessary. The right channel audio signal could be processed in the same manner so that amplifier 18L' is not necessary.

In the implementations of FIGS. 5A and 5B, the loudspeaker modules 32L, 32R, 32LS, and 32RS are interchangeable; however, the implementations of FIGS. 5A and 5B require no system for identifying the loudspeaker modules. The stands 38LS and 38RS are not moved when the loudspeaker modules 32LS and 32RS are exchanged to recharge the batteries.

Figure 6:
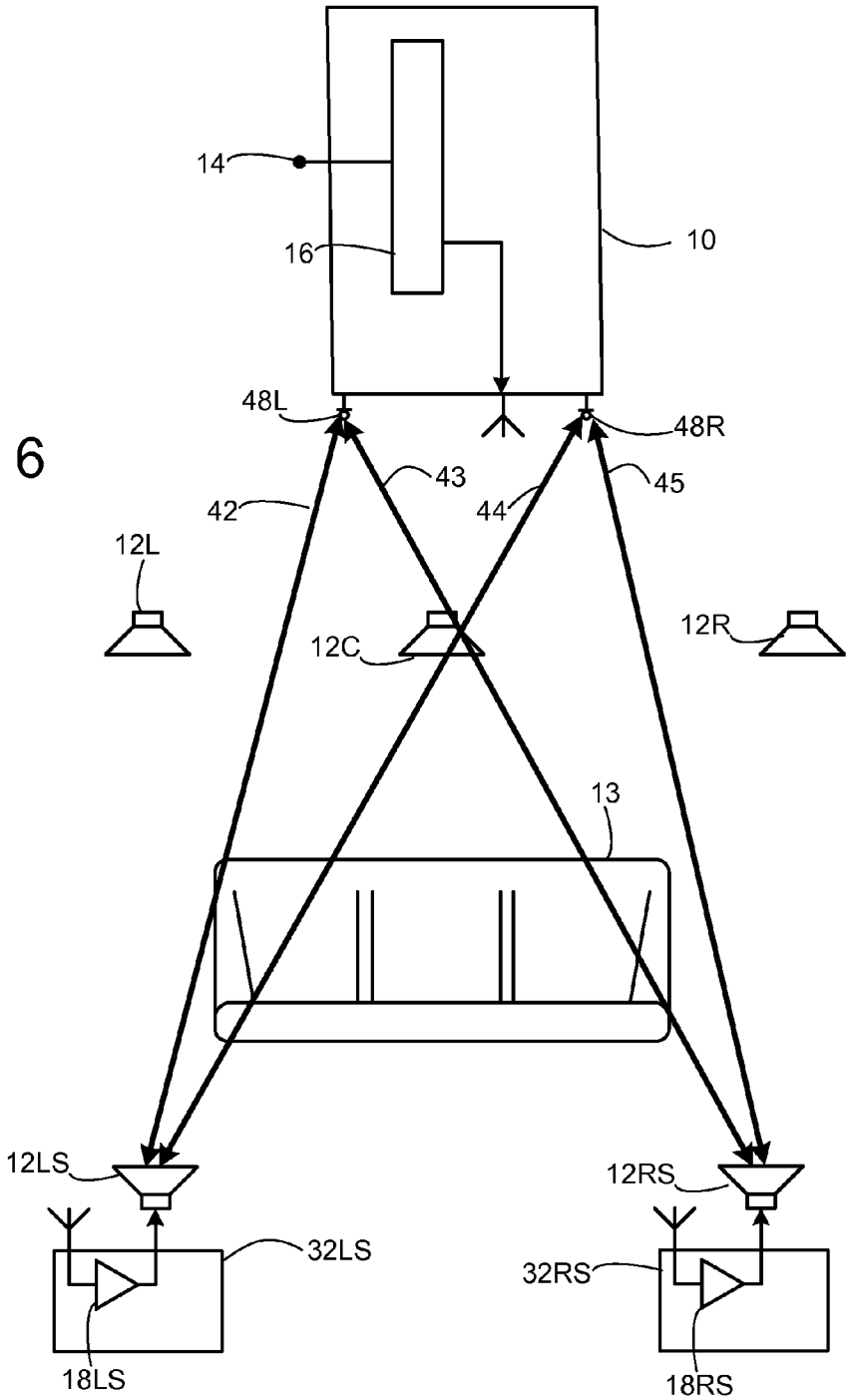
FIG. 6 is a block diagram of an audio system illustrating a method for determining the relative placement of two loudspeaker modules.

In some of the embodiments, for example the embodiment of FIG. 3 in which some loudspeaker modules 32L, 32R, 32LS, and 32LR (and in some implementations 32C) are identical and interchangeable, it would be possible for a user to interchange speaker pairs in more than one combination. For example, if charged loudspeaker modules 32L and 32R are being interchanged with discharged loudspeaker modules 32LS and 32RS, the user could interchange charged loudspeaker module 32L with discharged loudspeaker module 32LS and interchange charged loudspeaker module 32R with discharged loudspeaker module 32RS; or the user could interchange charged loudspeaker module 32L with discharged loudspeaker module 32RS and to interchange charged loudspeaker module 32R with discharged loudspeaker module 32LS. It would then be possible for the left surround audio channel to be radiated to the user's right and for the right surround audio channel to be radiated to the user's left. FIG. 6 illustrates a method for ensuring the left surround audio channel is radiated from the user's left and the right surround audio channel is radiated from the user's right. For simplicity, some elements of previous figures that are not necessary for the explanation of FIG. 6 are omitted from the figure. In the method of FIG. 6, a test signal is transmitted sequentially to both acoustic drivers so that the distance 42 (from left microphone 48L to left surround acoustic driver 12LS), distance 43 (from left microphone 48L to right surround acoustic driver 12RS) distance 44 (from right microphone 48R to left surround acoustic driver 12LS) and distance 45 (from right microphone 48R to right surround acoustic driver 12RS) can be determined. Alternatively, the relative distance (for example which of the distances 42, 43, 44, and 45 is the greatest, which is the next greatest, and so on). The distance or relative distance from the microphone to the acoustic driver can be determined by some combination of measuring delay between the radiating of the test signal and the arrival at the microphone or by measuring the amplitude of the radiation at the microphones. From the distances, the location of the loudspeaker modules can be determined, thus determining which loudspeaker module is the left surround loudspeaker module and which speaker is the right surround speaker. The microphones may be housed in the system console or in a bass module.

In another method each loudspeaker module could have a switch or indicator for the user to set to indicate whether the loudspeaker module is a left surround loudspeaker module or a right surround loudspeaker module.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. An audio system comprising:

a battery charger for charging rechargeable batteries; and a loudspeaker assembly intended to be placed in back of a listening position comprising a rechargeable battery, a wireless audio signal receiver, an amplifier, and an acoustic driver.

2. The audio system of claim 1, wherein the rechargeable battery, the wireless audio signal receiver, the amplifier, and the acoustic driver are packaged in a single module.

3. The audio system of claim 2, comprising four interchangeable modules, each comprising the loudspeaker assembly of claim 1.

4. The audio system of claim 1, wherein the rechargeable battery is decoupleable from an acoustic driver module comprising the amplifier and the acoustic driver.

5. The audio system of claim 4, wherein the battery charger is a part of an audio system console.

6. The audio system of claim 4, wherein the battery charger is part of a loudspeaker module.

7. The audio system of claim 1, wherein a wireless audio receiver module comprises the wireless audio signal receiver and is decoupleable from an acoustic driver module comprising the one rechargeable battery and the acoustic driver.

8. The audio system of claim 7, wherein the wireless audio receiver module further comprises the amplifier.

9. The audio system of claim 7, wherein the wireless receiver module is incorporated in a loudspeaker stand.

10. The audio system of claim 9, the audio system further comprising:

a second wireless receiver module, incorporated in a second loudspeaker stand; and four interchangeable acoustic driver modules, each comprising another of the rechargeable batteries and another acoustic driver.

11. The audio system of claim 10, wherein the four interchangeable acoustic driver modules each comprise another amplifier.

12. The audio system of claim 1, the loudspeaker assembly further comprising a photovoltaic cell for recharging the rechargeable battery.

13. The audio system of claim 1, wherein the battery charger is an inductive charger.

14. The audio system of claim 1, wherein the battery charger is housed in a system console.

15. The audio system of claim 1, wherein the battery charger is housed in a speaker stand.

16. The audio system of claim 1, further comprising logic to estimate the energy remaining in the battery.

17. An audio system, comprising:

at least two battery chargers, coupled to an electrical power source;

at least four loudspeaker assemblies, the four loudspeaker assemblies comprising two sets of two loudspeaker assemblies, each loudspeaker assembly comprising an acoustic driver and a rechargeable battery, the four loudspeaker assemblies being physically coupleable to at least one of the battery chargers, the four loudspeaker assemblies configured so that the four loudspeaker assemblies are operable when physically separated from the battery chargers;

circuitry for determining the state of charge of the rechargeable batteries when the loudspeaker assemblies are being operated physically separated from the battery chargers; and circuitry, responsive to the circuitry for determining the state of charge of the rechargeable batteries, for informing a user that the state of charge of at least one of the rechargeable batteries is below a predetermined level.

18. The audio system of claim 17, wherein the two sets of two loudspeaker assemblies are interchangeable so that the four loudspeakers are interchangeable with each other.

19. The audio system of claim 17, wherein the four loudspeaker assemblies further comprise an amplifier and a wireless receiver.

20. The audio system of claim 17, wherein each of the loudspeaker assemblies is coupleable to a device comprising a wireless receiver and an amplifier.

21. The audio system of claim 17, further comprising a third battery charger.

22. The audio system of claim 17, further comprising logic for determining the relative position of two of the loudspeaker assemblies that are physically separated from a system console.

23. A method for identifying the relative location of at least two loudspeakers, comprising:

positioning at least two acoustic drivers in a room;

causing each of two drivers to radiate acoustic energy;

detecting, by a first microphone, radiation from each of the two acoustic drivers;

determining one of the distance or the relative distance of the first loudspeaker and of the second loudspeaker from the first microphone;

detecting, by a second microphone, radiation from each of the two acoustic drivers;

determining one of the distance or the relative distance of the first loudspeaker and of the second loudspeaker from the second microphone;

based on the distances or the relative distances of the first loudspeaker and the second loudspeaker from the first microphone and the second microphone, determining that one of the first loudspeaker and the second loudspeaker is a left surround loudspeaker and other of the first loudspeaker and the second loudspeaker is a right surround loudspeaker.

* * * * *